US012605016B2

(12) United States Patent
Knodle et al.

(10) Patent No.: US 12,605,016 B2
(45) Date of Patent: Apr. 21, 2026

(54) TOWEL TAB DEVICE FOR RETAINING A TOWEL IN PLACE ABOUT A USER

(71) Applicant: Towel Tab Innovations LLC, Grand Rapids, MI (US)

(72) Inventors: Gina M. Knodle, Fayetteville, AR (US); Bethany D. VanOeffelen, Grand Rapids, MI (US); Michael E. Nipke, Wyoming, MI (US)

(73) Assignee: Towel Tab Innovations LLC, Grand Rapids, MI (US)

( * ) Notice: Subject to any disclaimer, the term of this patent is extended or adjusted under 35 U.S.C. 154(b) by 893 days.

(21) Appl. No.: 17/543,066

(22) Filed: Dec. 6, 2021

(65) Prior Publication Data

US 2023/0172402 A1 Jun. 8, 2023

(51) Int. Cl.
*A47K 10/02* (2006.01)
*A47K 10/12* (2006.01)

(52) U.S. Cl.
CPC ..... *A47K 10/12* (2013.01); *A47K 10/02* (2013.01); *Y10T 428/24008* (2015.01)

(58) Field of Classification Search
CPC ..... A47K 10/02; A47K 10/025; A47K 10/12; A47K 10/14; A45D 44/08
See application file for complete search history.

(56) References Cited

U.S. PATENT DOCUMENTS 2,469,302 A 5/1949 Kelleher
3,160,892 A 12/1964 Semons
4,669,128 A 6/1987 Furgang
4,771,502 A * 9/1988 Trimble ..... A45F 5/00 15/209.1
5,720,043 A 2/1998 White, Sr.
5,756,177 A 5/1998 Cheong
6,405,415 B1 6/2002 Meeks
7,788,733 B1 * 9/2010 Zahner ..... A47K 10/02 211/113
7,921,527 B2 4/2011 Moy
7,963,010 B2 6/2011 Levesque
9,226,626 B2 1/2016 Sprague et al.
10,045,574 B2 8/2018 Darnell
(Continued)

FOREIGN PATENT DOCUMENTS

AU 2001100524 A4 11/2001
AU 2019100963 A4 10/2019
(Continued)

*Primary Examiner* — Alicia Chevalier

(74) *Attorney, Agent, or Firm* — Gardner, Linn, Burkhart & Ondersma LLP

(57) ABSTRACT

A towel with an integrated retention tab includes a distal end, opposed sides, and a proximal end that is affixed to a towel. The retention tab is formed of a different material than the towel, and is secured to the towel at an attachment area. The retention tab is configured to be positioned over a portion of the towel that is wrapped around a person's body in order to assist with retaining the towel in a wrapped position around the person's body. For increased securing ability, the retention tab may optionally have tapered edges and/or define a gripping pattern. Furthermore, the retention tab may define a through hole to allow the retention tab and the affixed towel to be hung for drying and/or storage purposes.

20 Claims, 14 Drawing Sheets

(56) References Cited

U.S. PATENT DOCUMENTS

| | | | | |
|---|---|---|---|---|
| 2011/0314584 | A1 | 12/2011 | Wang | |
| 2012/0174284 | A1 | 7/2012 | Lugtu | |
| 2015/0374180 | A1 | 12/2015 | Gallmon-Perry | |
| 2016/0135518 | A1 | 5/2016 | Scott | |
| 2017/0049279 | A1 | 2/2017 | Wood et al. | |
| 2017/0079485 | A1 | 3/2017 | Johnson | |
| 2017/0303614 | A1 | 10/2017 | McMahon | |
| 2021/0127768 | A1* | 5/2021 | Swope ..... | A47G 25/00 |

FOREIGN PATENT DOCUMENTS

| | | | |
|---|---|---|---|
| DE | 102009027237 | A1 | 12/2010 |
| FR | 1112048 | A | 3/1956 |
| FR | 1331157 | A | 6/1963 |
| FR | 2560512 | A1 | 9/1985 |
| GB | 2362918 | B | 6/2004 |
| JP | 3189243 | U | 3/2014 |
| KR | 200327667 | Y1 | 9/2003 |
| WO | 2003051149 | A1 | 6/2003 |

* cited by examiner

TOWEL TAB DEVICE FOR RETAINING A TOWEL IN PLACE ABOUT A USER

BACKGROUND AND FIELD OF THE INVENTION

The present invention relates generally to a towel, and particularly to a retention tab or member integrated to a towel that aids in wrapping and securing a towel around a portion of a person's body.

Towels are used in a wide variety of contexts, including to wipe, absorb, or otherwise move a fluid such as water. A towel may be specifically used by a person to dry themselves off after bathing, swimming, or other such water activities. When not using a towel for actively drying oneself, it is sometimes convenient or desired to secure the towel to one's body such that the towel remains in place without having to hold the towel with either hand.

SUMMARY OF THE INVENTION

In accordance with the present invention a towel includes a retention or attachment tab or member, with the retention tab adapted to secure a towel in a wrapped position around a person's body. A towel with an integrated retention member in accordance with the present invention is configured with the retention member affixed at or near the edge and/or corner of the towel. In a particular embodiment the retention member has a wedge shape that promotes user comfort and ease of use of the retention member in securing the towel in the wrapped position around a person. Optionally, the retention member may be formed to define or otherwise accommodate various gripping patterns and shapes on its surface, and may further be formed in different colors, shapes, and sizes. The retention member, moreover, is configured to be of sufficient weight and stiffness to promote or aid the engagement of the retention member with the towel when wrapped about a wearer in order to promote or aid in retaining the towel about the wearer.

According to one form of the invention, a towel includes an integrated retention tab that is formed of a different material than the towel. The retention tab has a distal end, opposed sides, and a proximal end that is attached to the towel. The retention member can be positioned over a portion of the towel that has been wrapped around a person in order to assist with securing the towel in place after the towel has been wrapped around the person.

The retention member may be attached to or at an edge of the towel in a downward or upward attachment configuration.

In another aspect, the distal end terminates in a tapered edge.

In yet another aspect, the retention member includes a through hole.

In a still another aspect, the retention member also defines a gripping pattern.

Thus, the towel with integrated retention member in accordance with the present invention enables a person to easily and conveniently secure a towel around their body. The retention member is located in a non-obstructive location so as to not interfere when someone is using the towel for drying purposes. Additionally, the retention member is shaped so that it may be easily inserted into a position between a wrapped towel and the person. In this position, the retention member holds the towel in the wrapped position. Furthermore, the retention member is durable and machine washable.

These and other objects, advantages, purposes and features of the present invention will become apparent upon review of the following specification in conjunction with the drawings.

DETAILED DESCRIPTION OF THE PREFERRED EMBODIMENTS

Figure 1B:
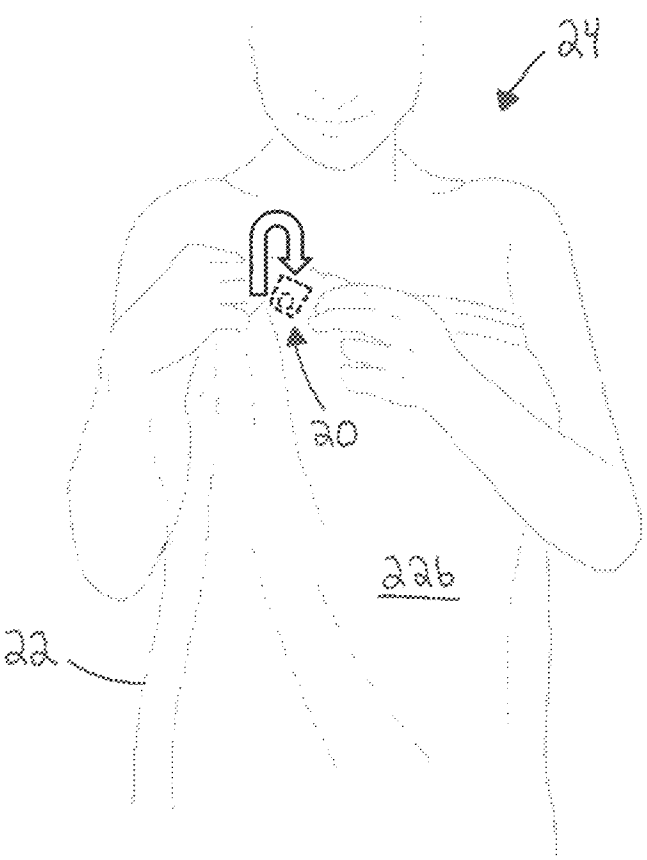
FIG. 1B is another perspective view of the towel of FIG. 1A, shown wrapped and tucked around the person of FIG. 1A.

The present invention will now be described with reference to the accompanying figures, wherein the numbered elements in the following written description correspond to like-numbered elements in the figures. A towel 22 in accordance with the present invention includes a retention or attachment member or tab 20 that in the illustrated embodiment is made of a semi-rigid material having a shape and texture that allows it to secure and maintain the towel 22 in a wrapped position around a person 24. Towel 22 is made of a cotton fabric, or other similar cloth-like material. Retention tab 20 is affixed to towel 22 in a suitable location, such as by sewing into a seam, so as not to interfere with using the towel for drying oneself. To further enhance its ability to secure towel 22 around a person, retention tab 20 is wedge-shaped such that it is thicker in a central location between a front face 27 and a rear face 29 and thinner at a distal end 20*b* and lateral edges or side edges 26. Front and back faces 27, 29 are surrounded by and slightly contoured to connect with distal end 20*b*, edges 26, and proximal end 20*a*. Front and back faces 27, 29 gradually become less contoured and more planar radially inward from distal end 20*b*, edges 26, and a proximal end 20*a*. Optionally, the retention tab may include a grommet 28 with a through hole 30 that enables the affixed towel to be easily and conveniently hung from a hook 32 (FIG. 2) for drying or storage purposes. Additionally, various gripping patterns and aesthetic designs can be molded, engraved, or otherwise affixed to or otherwise integrated on the retention tab 20 to further aid in retaining the towel 22 to the wearer 24, and the towel and retention tab itself may come in many different shapes, sizes and colors.

Figure 1A:
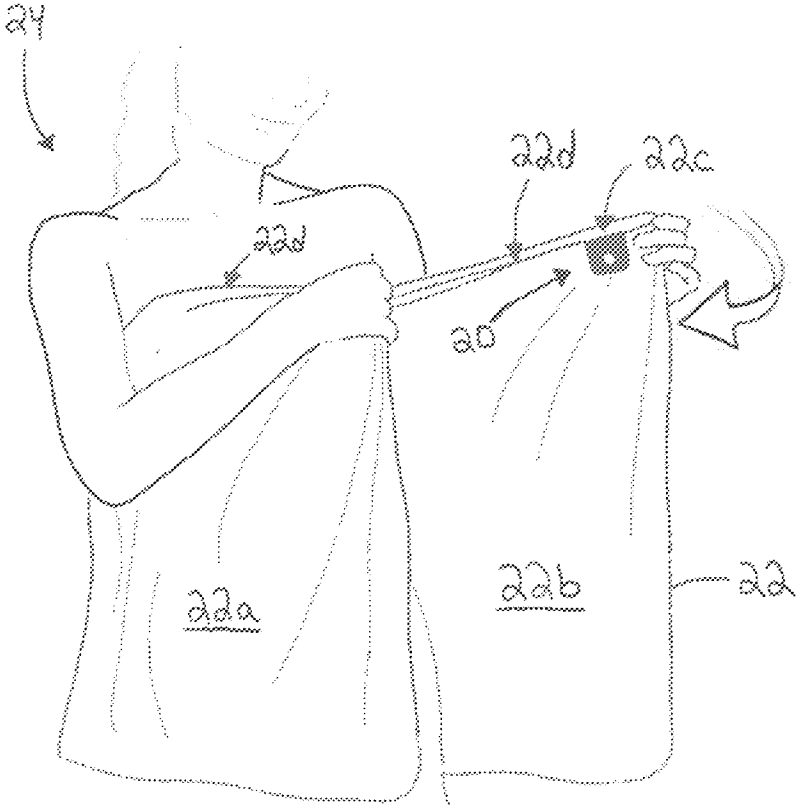
FIG. 1A is a perspective view of a person wrapping a towel around their body in which the towel is configured in accordance with the present invention and includes an integrated retention member with a grommet.

As understood from FIGS. 1A and 1B, in the illustrated embodiment retention tab 20 is secured to a long edge 22*d* of towel 22 proximate a corner thereof. An individual 24 is able to secure towel 22 about their body by wrapping the towel 22 thereabout such that the portion of the towel 22 with the retention tab 20 overlaps the portion of the towel 22 wrapped about the body of the individual 24. The retention tab 20 is then tucked in over the long edge 22*d* of the overlapped portion with the retention tab 20 disposed against the body of the individual 24. In the illustrated embodiment retention tab 20 is constructed of an elastomeric material and is of sufficient weight that aids in retention of the towel. For example, retention tab 20 has a density that is greater than that of the towel 22. The retention tab 20 may be slightly bendable—i.e. a user can deflect the retention tab 20 with their hands, but the retention tab 20 will return to its straight orientation.

In particular, first, the person 24 wraps a body-side portion 22*a* of towel 22 around their body, leaving an outside 22*b* portion of towel 22, including an attachment area 22*c*, unwrapped (FIG. 1A). Body-side portion 22*a* is preferably wrapped around person 24 in a reasonably tight but still comfortable manner. Person 24 may then wrap the remaining outside portion 22*b* of towel 22 around their body. To secure towel 22 in this wrapped position, person 24 may tuck retention tab 20 in-between body-side portion 22*a* and person 24 by moving retention tab 20 from an undeployed position (FIG. 1A) to the deployed position (FIG. 1B). Towel 22 may also be secured in the wrapped position by keeping the full body of retention tab 20 pressed against outside portion 22*b* of towel 22, and then folding and tucking retention tab 20 and a part of outside portion 22*b* in-between person 24 and body-side portion 22*a*. In this method, retention tab 20 would not be in contact with body-side portion 22*a*, and would instead be sandwiched between outside portion 22*b* and person 24. Additionally, the location of attachment area 22*c* ensures that retention tab 20 may be used effectively to secure towel 22 in the wrapped position, while also not interfering with a person using towel 22 for drying purposes or otherwise. It will be understood that a retention tab can be used to secure a towel around other portions of a person's body, such as their waist, as well.

It should be recognized that there are numerous ways to secure towel 22 in the wrapped position using retention tab 20 depending on user preference, including after swimming when wearing a swimsuit or after showering, bathing or the like. Whatever method a user prefers, the process will follow similar basic principles. The process of wrapping towel 22 around person 24 creates tension in towel 22. The tension in towel 22 imparts an inward constricting force towards person 24. As such, inserting, wedging, or otherwise tucking retention tab 20 in-between towel 22 and person 24, or in-between respective portions of towel 22 itself, creates a frictional relationship or engagement between retention tab 20 and the adjoining surfaces of towel 22 or towel 22 and person 24, that allows retention tab 20 to secure and hold towel 22 in the wrapped position around person 24.

Referring now to the illustrated embodiment of FIGS. 3-9, edges 26 of retention tab 20 extend between proximal end 20*a* and distal end 20*b* of retention tab 20. To promote comfort of person 24, all portions of retention tab 20 that can come into contact with person 24 have rounded, curved, and/or smooth edges, as well as to inhibit retention tab 20 from snagging on items, including when towel 22 is being washed or worn. In this regard, edges 26 are connected to distal end 20*b* via rounded corners 34. In the illustrated embodiment, retention tab 20 has a wedge shape with contoured surfaces. That is, the thickness of retention tab 20 is greater between front and back sides 27, 29, which are nearer to the geometric center of retention tab 20, and reduced near edges 26, proximal end 20*a*, and distal end 20*b*, such that edges 26, proximal end 20*a*, and distal end 20*b* have tapered edges. The contoured surfaces and wedge shape of retention tab 20 allow it to be easily wedged and/or inserted into an ideal securing position, or deployed position. It should be appreciated that the configuration of proximal end 20*a* as being thinner than the center of retention tab 20 may also aid in securing retention tab 20 with towel 20, such as being sewn there through. Alternatively, however, proximal end 20*a* need not be thinner. In the deployed position, attachment area 22*c* and/or proximal end 20*a* of retention tab 20 is located above an upper edge 22*d* of body-side portion 22*a* of towel 22, and retention tab 20 is positioned between towel 22 and person 24.

Figure 16A:
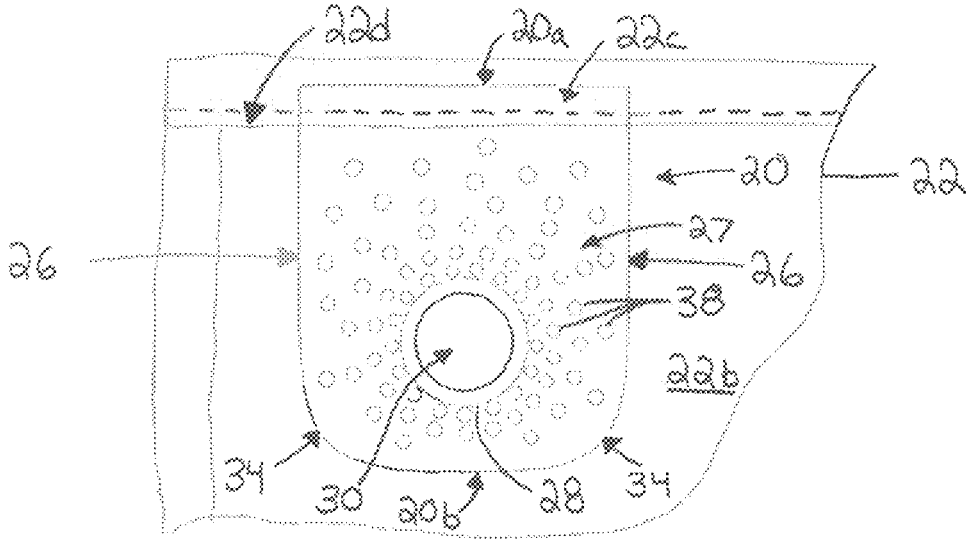
FIG. 16A is an elevation view of the retention member of FIG. 3 shown attached to a towel in a downward attachment configuration as shown in in FIG. 1A.
Figure 16B:
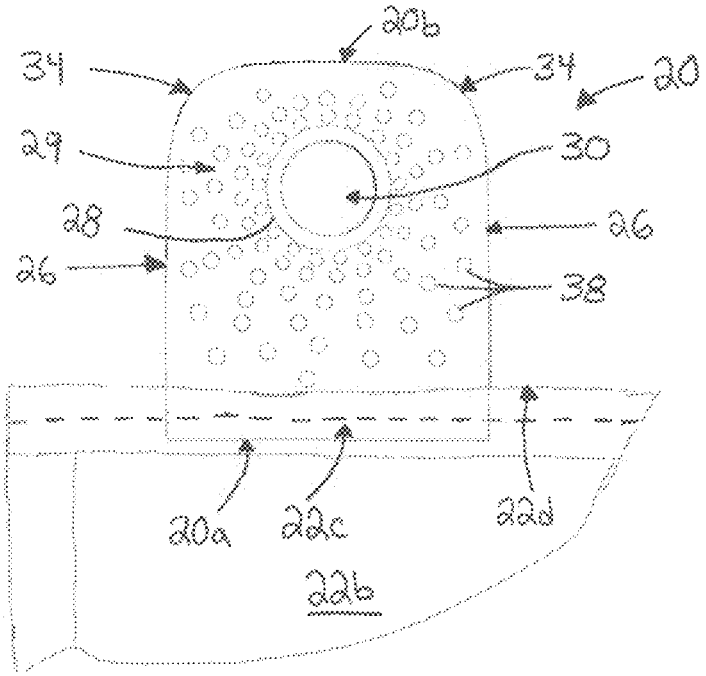
FIG. 16B is an elevation view of the retention member of FIG. 3 shown attached to a towel in an upward attachment configuration.

Retention tab 20 may also be affixed to towel 22, such as at a seam or hem or edge of towel 22, in either a downward attachment configuration (FIG. 16A) or an upward attachment configuration (FIG. 16B). As shown in the illustrated embodiment of FIGS. 1A, 1B, and 16A, retention tab 20 is affixed to attachment area 22*c* of towel 22 in the downward attachment configuration. In the illustrated embodiment of FIG. 16A, attachment area 22*c* is located at a towel seam or hem or upper edge 22*d* of towel 22, and near a corner of towel 22, with retention tab 20 being sewn into the seam of towel 22. For example, retention tab 20 may be sewn in place so that the edge 22*d* overlaps proximal end 20*a* whereby end 20*a* is covered by the edge 22*d* of towel 20. Alternatively, retention tab 20 may be sewn to an outside of the edge 22*d* of towel 20. Attaching retention tab 20 to towel 22 in this manner results in retention tab 20 having a default orientation in which it is facing downward from upper edge 22*d* of towel 22. Retention tab 20 is affixed to towel 22 in the upward attachment configuration of FIG. 16B by first folding upper edge 22*d* over proximal end 20*a* of retention tab 20, and then stitching or sewing thread or other cordage through both attachment area 22*c* and proximal end 20*a* of retention tab 20. As will be discussed in more detail, retention tab 20 may also extend through or into an opening or pocket 3 in an overlapping edge 22*d* of towel 20 in which proximal end 20*a* is covered by such an overlapping edge 22*d*, or may be sewn to an outside of the edge 22*d* of towel 20. It should be appreciated that towel 20 may not have an overlapping long edge 22*d*. It should further be appreciated that retention tab 20 may be affixed to towel 22 in alternative manners other than sewing, such as by being adhesively affixed to towel 22.

Securing towel 22 around person 24 when retention tab 20 is affixed to towel 22 in the upward attachment configuration (FIG. 16B) requires moving and/or flexing retention tab 20 downward in order to tuck retention tab 20 in-between person 24 and towel 22. This results in different frictional characteristics between retention tab 20, towel 22, and person 24 as compared to tucking retention tab 20 in-between person 24 and towel 22 when retention tab 20 has been affixed to towel 22 in the downward attachment configuration (FIG. 16A). The varying frictional characteristics resulting from each attachment configuration provide users with a choice of which configuration better suits their needs based on their body type, towel wrapping preferences, or other considerations.

It will be appreciated that a retention tab could be attached to a towel or other article through any method sufficient to create a connection durable enough to withstand repeated stress from moisture, washing detergents, heat, stretching, and other stresses due to repeated machine washing and drying. For example, other methods of attaching a retention tab to a towel or other article may include attachment through adhesion, crimping, or one or more fasteners. Additionally, a retention tab may be attached in other locations on a towel. For example, the retention tab could be attached to a towel such that the retention tab is flush with the corner of the towel, or extends past the corner and/or edge of the towel.

It should also be understood that, a retention tab could be attached to many different articles, including a wash cloth, a hand towel, a dish towel, or even articles of clothing such as a bathing suit. Furthermore, a towel with an integrated retention tab may be designed in various shapes, sizes, and colors to pair in a fashionable manner with existing articles of clothing.

Referring once again to the illustrated embodiments of FIGS. 3-9, retention tab 20 also includes multiple raised projections 38 disposed about the surfaces on both sides of retention tab 20, with the raised projections defining a gripping pattern to increase the ability of retention tab 20 to grip and maintain its position relative to towel 22 and person 24 when wrapped about the person 24. In the illustrated embodiment the gripping pattern formed by the series of raised circular projections 38 is disposed in a series of rings extending outward from grommet 28. It should be appreciated that a retention tab may be constructed without such projections on either side (see member 120), or may be included on just one side, or that the raised projections may be disposed in alternative patterns relative to that shown. The raised projections 38 are rounded so as to avoid irritating the skin of an individual 24, as well as inhibit projections 38 and retention tab 20 from snagging on other items, such as when being washed or worn.

Additionally, retention tab 20 may be made of a semi-rigid material capable of being bent and/or forced out of shape without breaking, and having the ability to return to its original shape and/or form after being bent and/or forced out of shape. The material makeup of retention tab 20 is also durable and capable of withstanding repeated machine washing and drying. The texture of retention tab 20 is such that it provides retention tab 20 with enhanced gripping characteristics without irritating skin or causing damage to delicate material that it may come into contact with, such as a bathing suit. For example, retention tab 20 of the illustrated embodiment may be made of a plastic, elastomeric or rubberized material, including various types of plastics including thermoplastic elastomers, silicone, nylon, and/or other materials with similar texture and rigidity. However, it should be understood that a retention tab could also be formed from or otherwise incorporate highly flexible materials and/or substantially rigid materials while remaining within the scope of the present invention. In the illustrated embodiment tab 20 has a density that is greater than that of the towel 22 to which it is attached to provide a greater weight or heft to aid retention tab 20 in securing towel 22 about the user.

Figure 2:
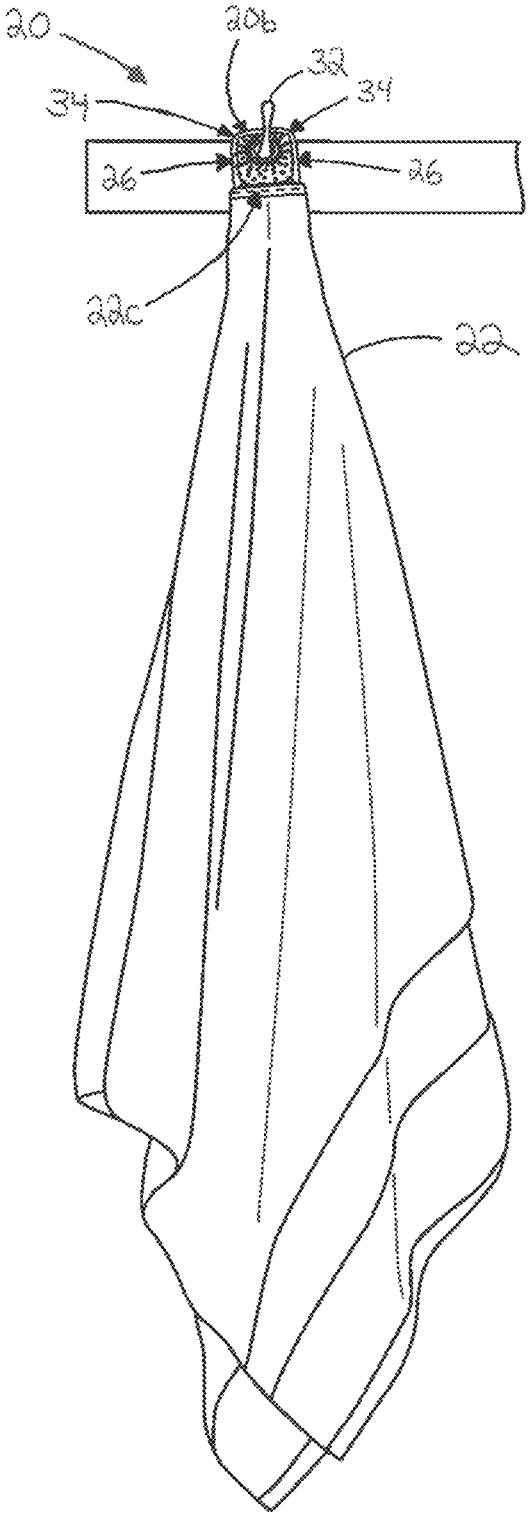
FIG. 2 is a perspective view of the towel of FIG. 1A shown hanging from a hook.
Figure 4:
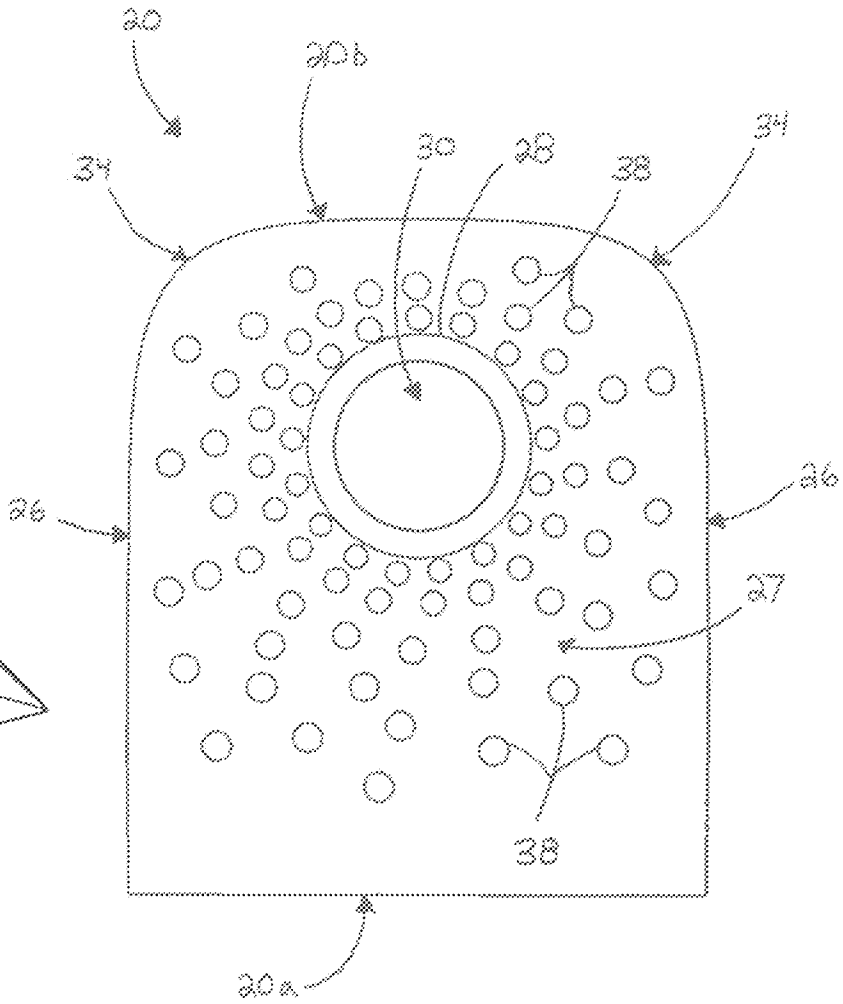
FIG. 4 is a front elevation view of the retention member of FIG. 3.
Figure 3:
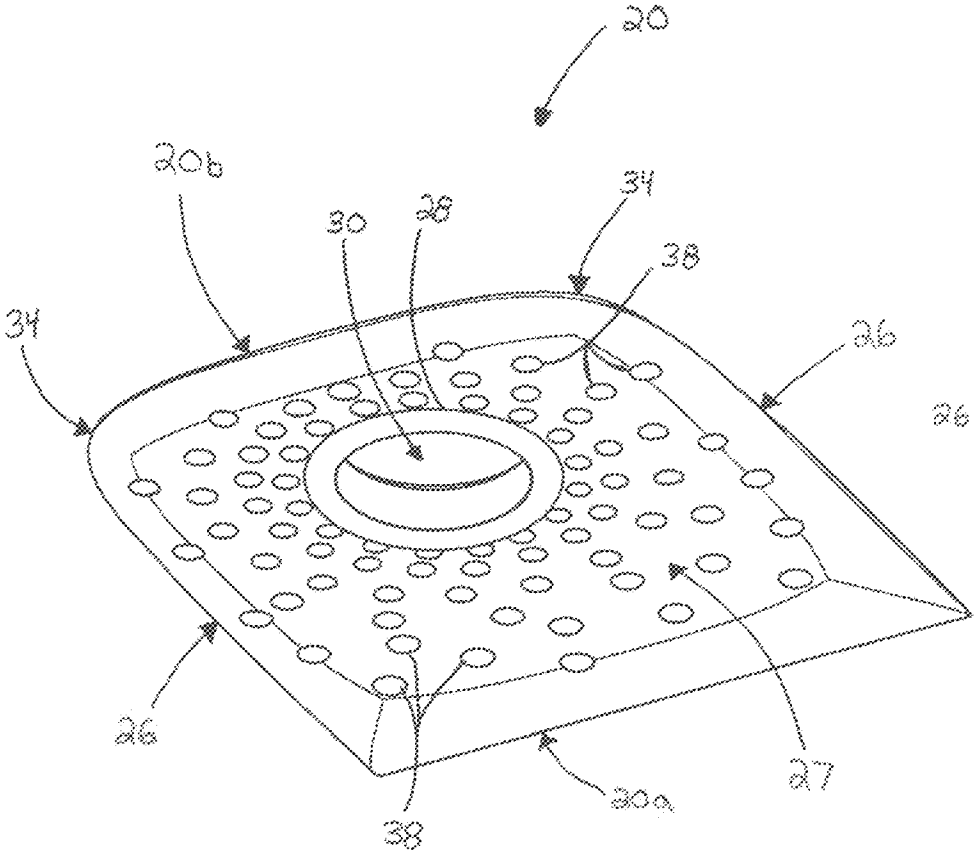
FIG. 3 is a perspective view of the retention member of FIG. 1A shown separated from the towel.
Figure 6:
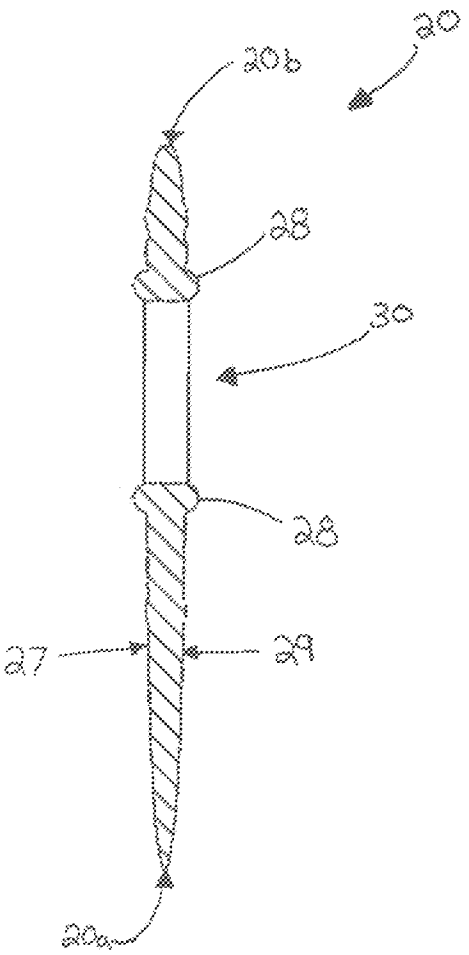
FIG. 6 is a sectional view of the retention member of FIG. 3, taken along line VI-VI of FIG. 5.
Figure 5:
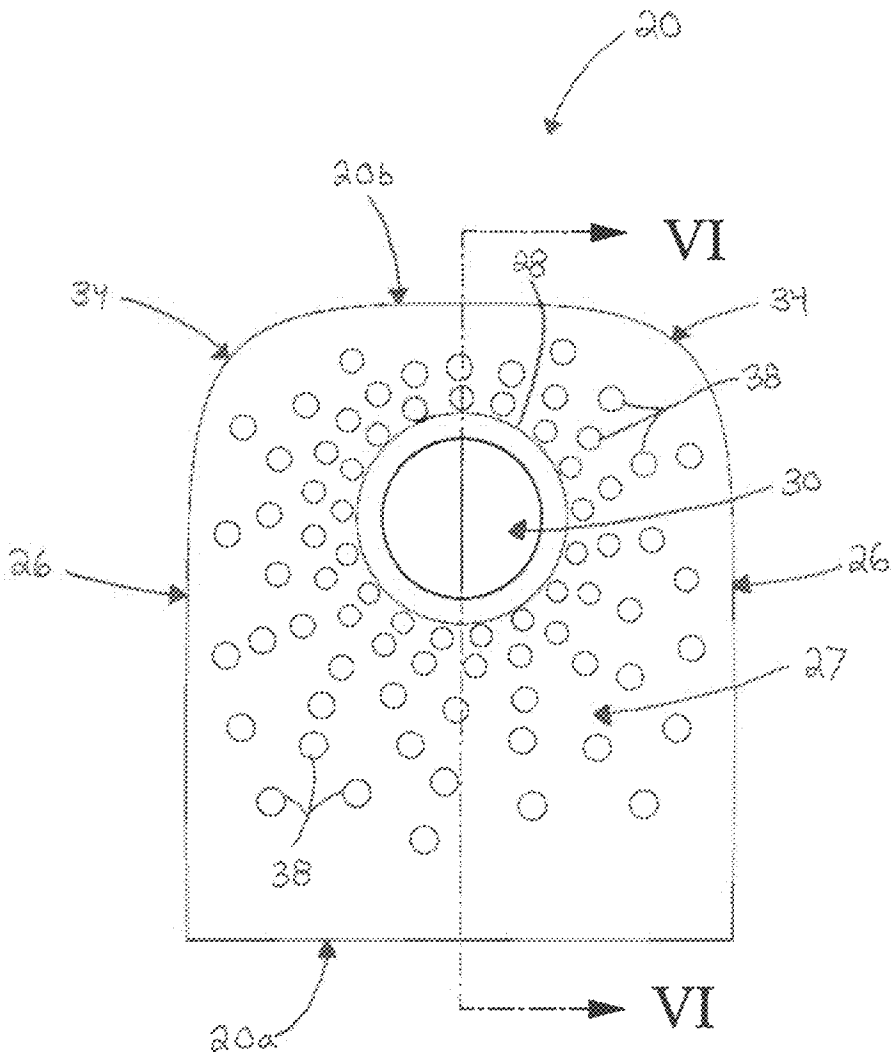
FIG. 5 is a rear elevation view of the retention member of FIG. 3.
Figure 9:
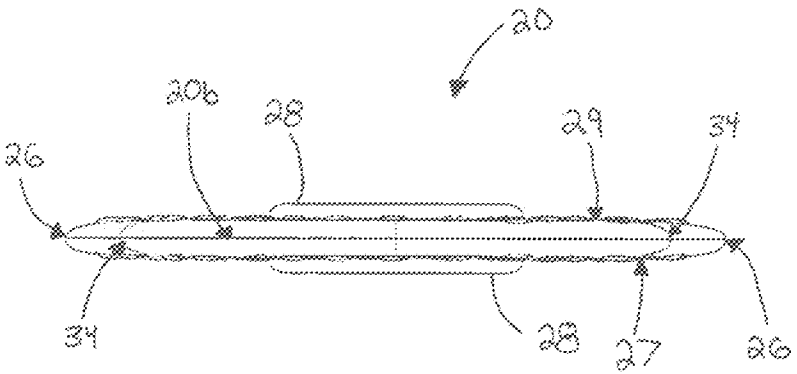
FIG. 9 is a top plan view of the retention member of FIG. 3.
Figure 8:
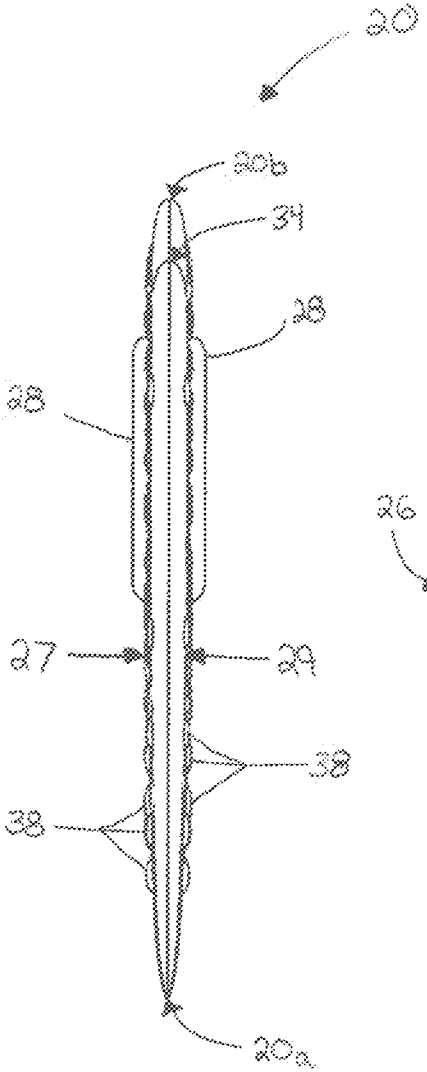
FIG. 8 is a left-side elevation view of the retention member of FIG. 3.
Figure 7:
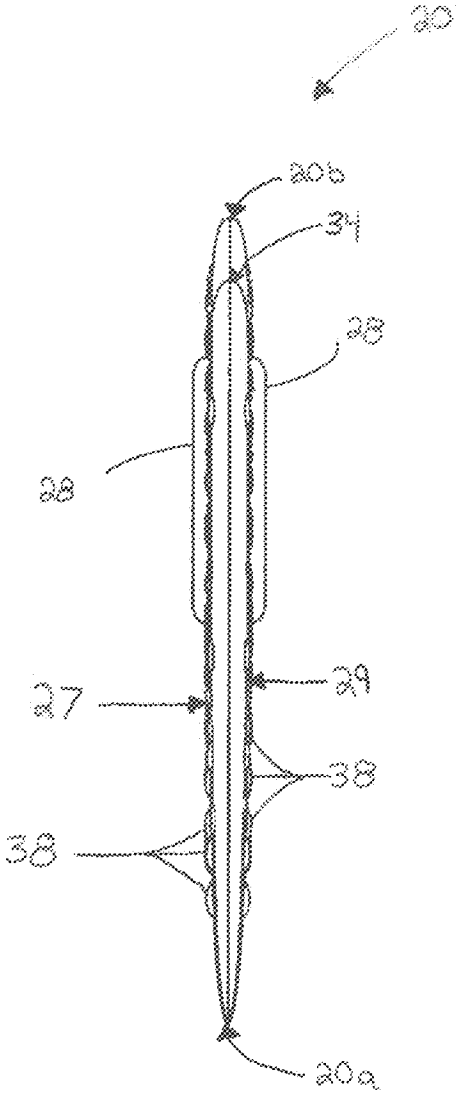
FIG. 7 is a right-side elevation view of the retention member of FIG. 3.
Figure 11:
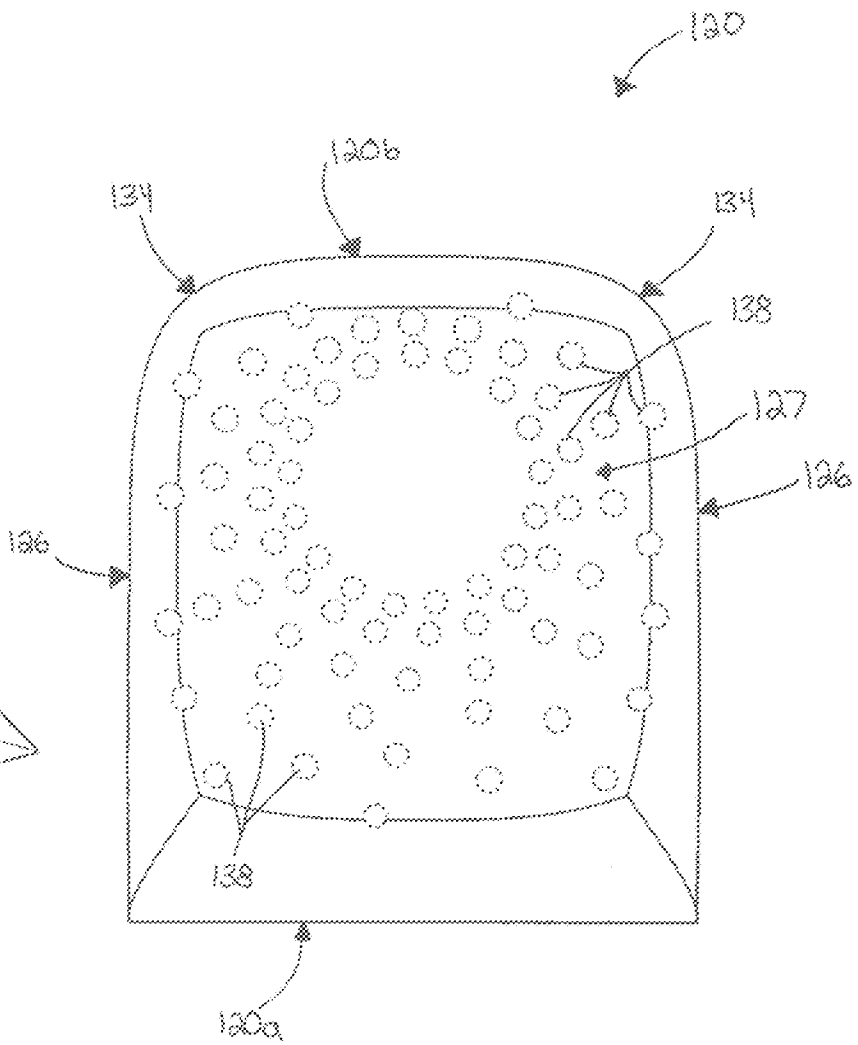
FIG. 11 is a front elevation view of the retention member of FIG. 10.
Figure 10:
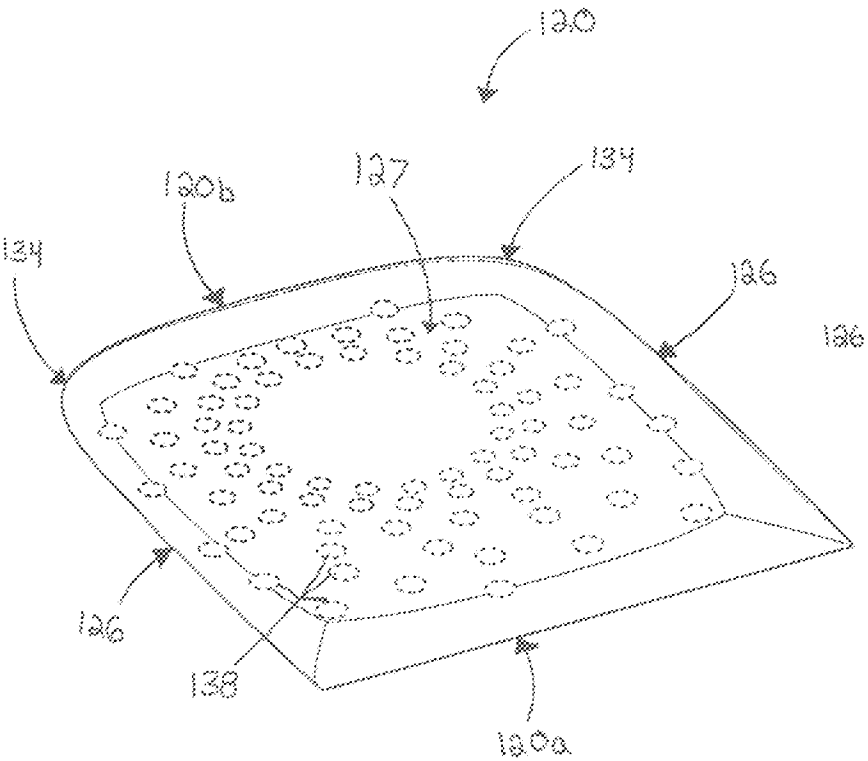
FIG. 10 is a perspective view of another retention member without a grommet in accordance with the present invention.
Figure 14:
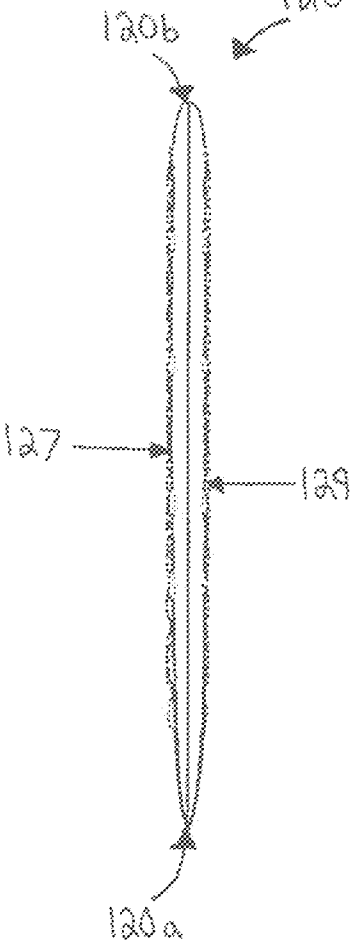
FIG. 14 is a left-side elevation view of the retention member of FIG. 10.
Figure 13:
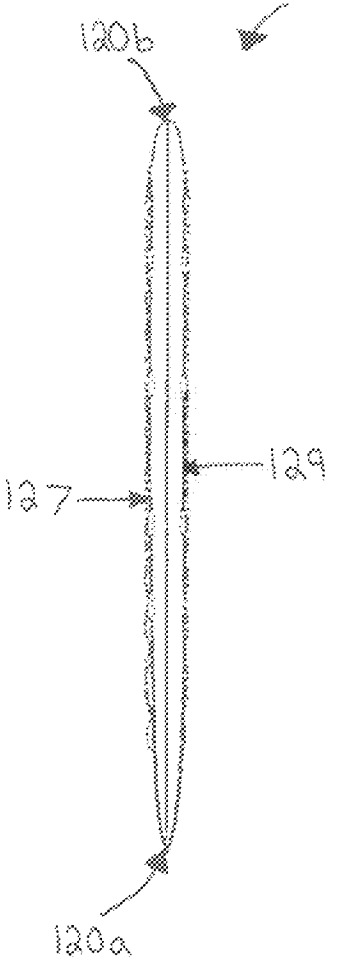
FIG. 13 is a right-side elevation view of the retention member of FIG. 10.
Figure 12:
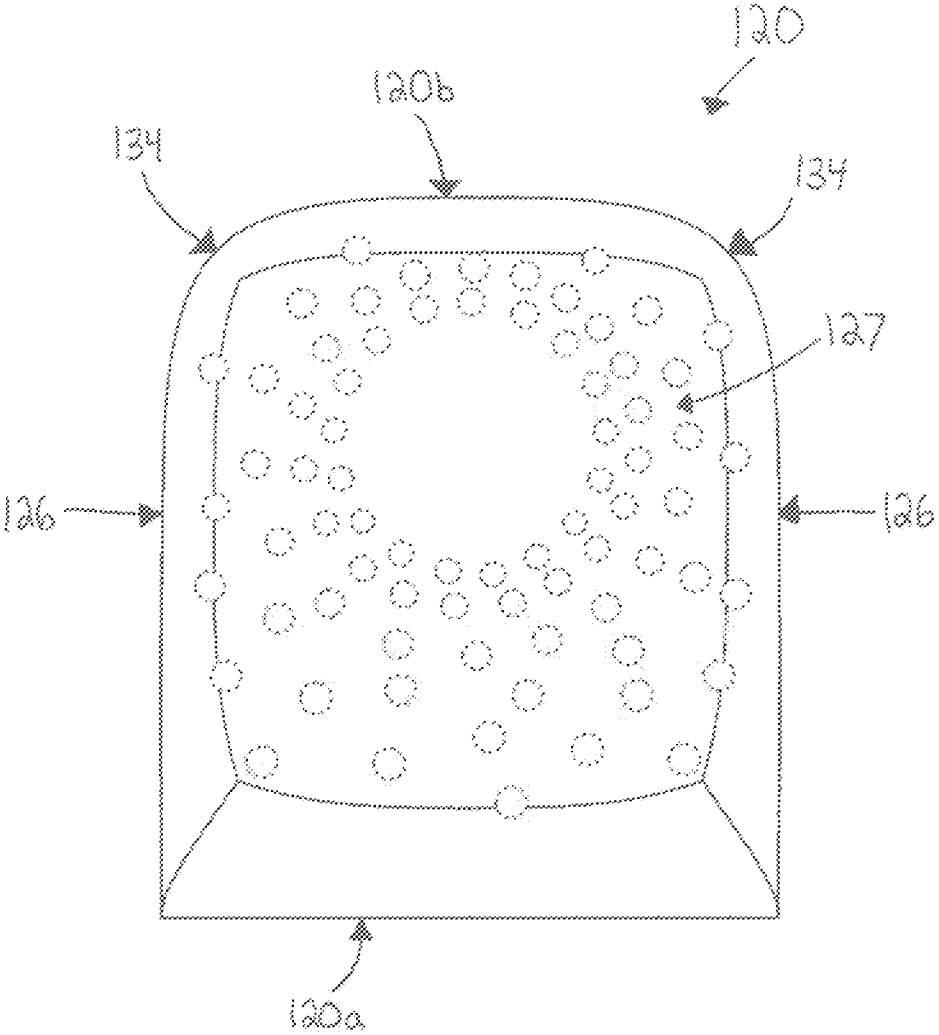
FIG. 12 is a rear elevation view of the retention member of FIG. 10.
Figure 15:
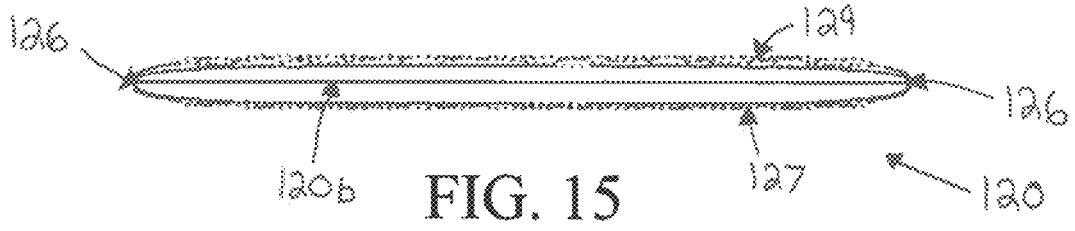
FIG. 15 is a top plan view of the retention member of FIG. 10.

Referring again to the illustrated embodiment of FIGS. 2-9, retention tab 20 defines grommet 28 around hole 30. Hook 32 or another object can be inserted though hole 30 to thereby hang retention tab 20 and any affixed towel from an elevated location for drying or storage purposes (FIG. 2). Grommet 28 increases the structural integrity of retention tab 20 by reinforcing the perimeter of hole 30 to protect against wear and tear caused by the insertion and removal of objects, such as hook 32. It will be appreciated that an integrated retention tab may not define a grommet and/or hole within the scope of the present invention. For example, referring to the illustrated embodiment of FIGS. 10-15, another retention tab 120, having reference numbers identical to retention tab 20 with 100 added to each reference number, does not define or include a grommet or through hole. In all other respects, retention tab 120 is substantially identical to the previously described retention tab 20.

Figure 19:
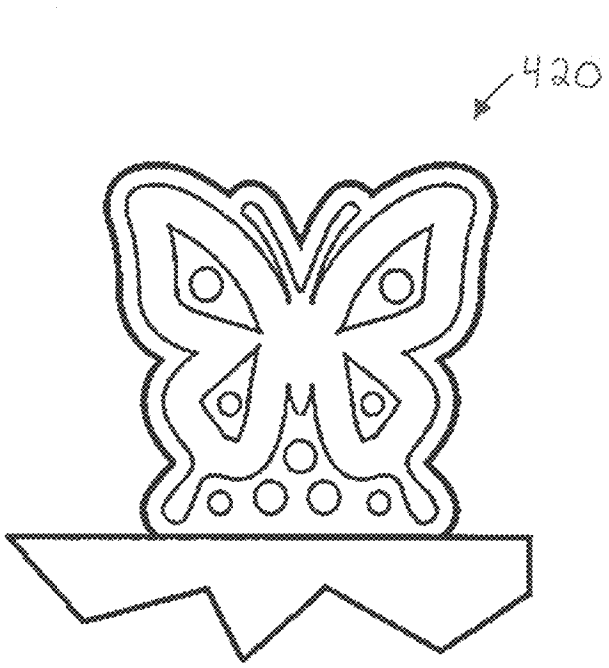
FIG. 19 is a partial end elevation view of a towel with an integrated retention member in accordance with the present invention, formed in the shape of a butterfly.
Figure 18:
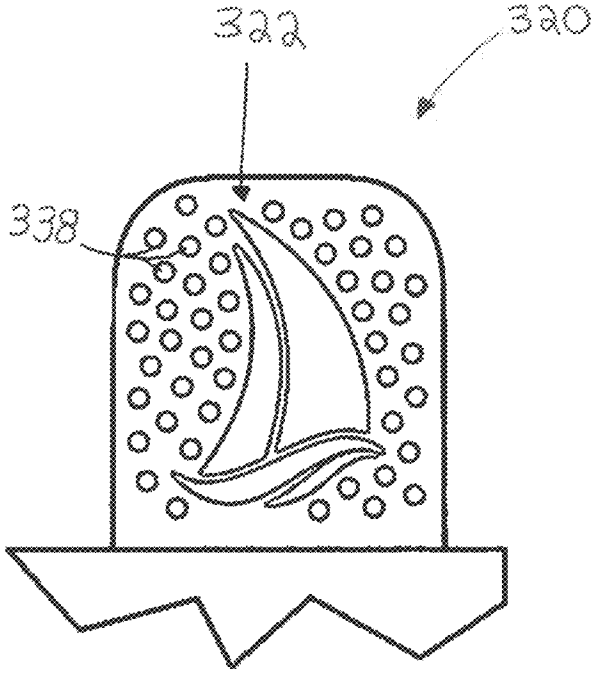
FIG. 18 is a partial end elevation view of a towel with an integrated retention member in accordance with the present invention, formed with the image of a sailboat.

A retention tab is highly customizable, and can be formed and/or engraved in many different shapes, sizes, and colors that are made to resemble various logos, plants, animals, and/or objects within the scope of the present invention. For example, a retention tab may define a gripping pattern in the form of a logo or in the form of a series of interconnected shapes, such as hexagons. Additionally, referring to the illustrated embodiment of FIG. 18, yet another retention tab 320 is formed and engraved to define a sailboat feature 322 within a gripping pattern of raised circular projections 338. Still another retention tab 420 is shown in the illustrated embodiment of FIG. 19, and is formed and/or engraved in the shape of a butterfly above various circular projections. Thus, it should be appreciated that a retention tab may be formed to have the outline of an animal, including insects, fish, whales or the like, as well as the outline of a ship or boat, planets, stars, or other celestial objects, a face or a caricature or character, such as a fictional character or cartoon character, or the like.

Figure 17A:
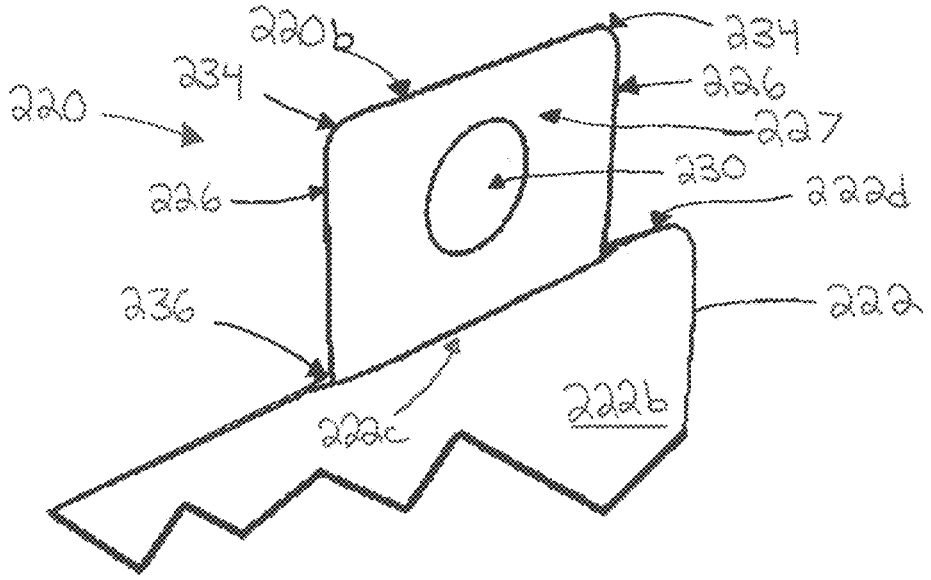
FIG. 17A is a perspective view of another towel having a retention member attached to the towel within a pocket of the towel where the retention member is shown in an un-deployed position.
Figure 17B:
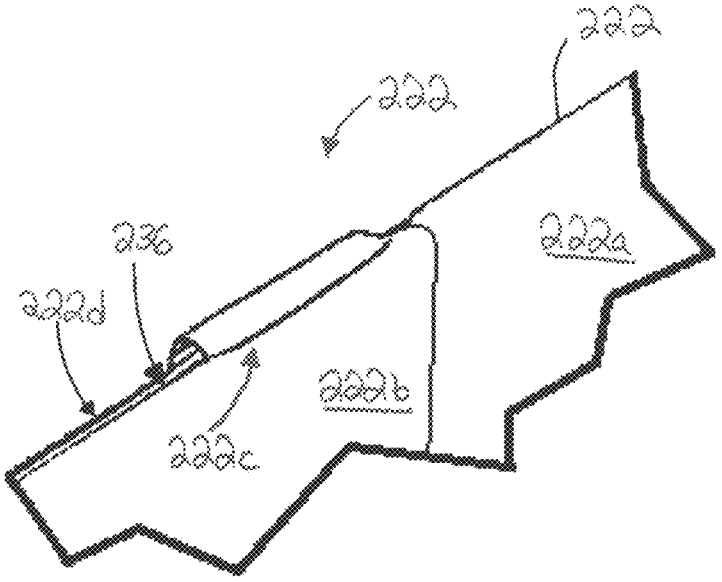
FIG. 17B is a perspective view of the towel of FIG. 17A shown in a deployed position.

Referring now to the embodiment of FIGS. 17A and 17B, an alternative retention or attachment tab or member 220 is shown affixed to towel 222, where retention tab 220 is substantially similar to retention tab 20 discussed above. As shown, retention tab 220 is affixed to towel 222 in the upward attachment configuration by inserting a proximal end (not shown) of retention tab 220 in a hole or pocket 236 formed in an overlapping edge 222*d* of towel 222. Once the proximal end is within pocket 236, the proximal end is secured to towel 222 at attachment area 222*c* via stitching. Attaching retention tab 220 to towel 222 in this manner results in retention tab 220 having a default orientation in which it is facing upward from upper edge 222*d* of towel 222.

Figure 20:
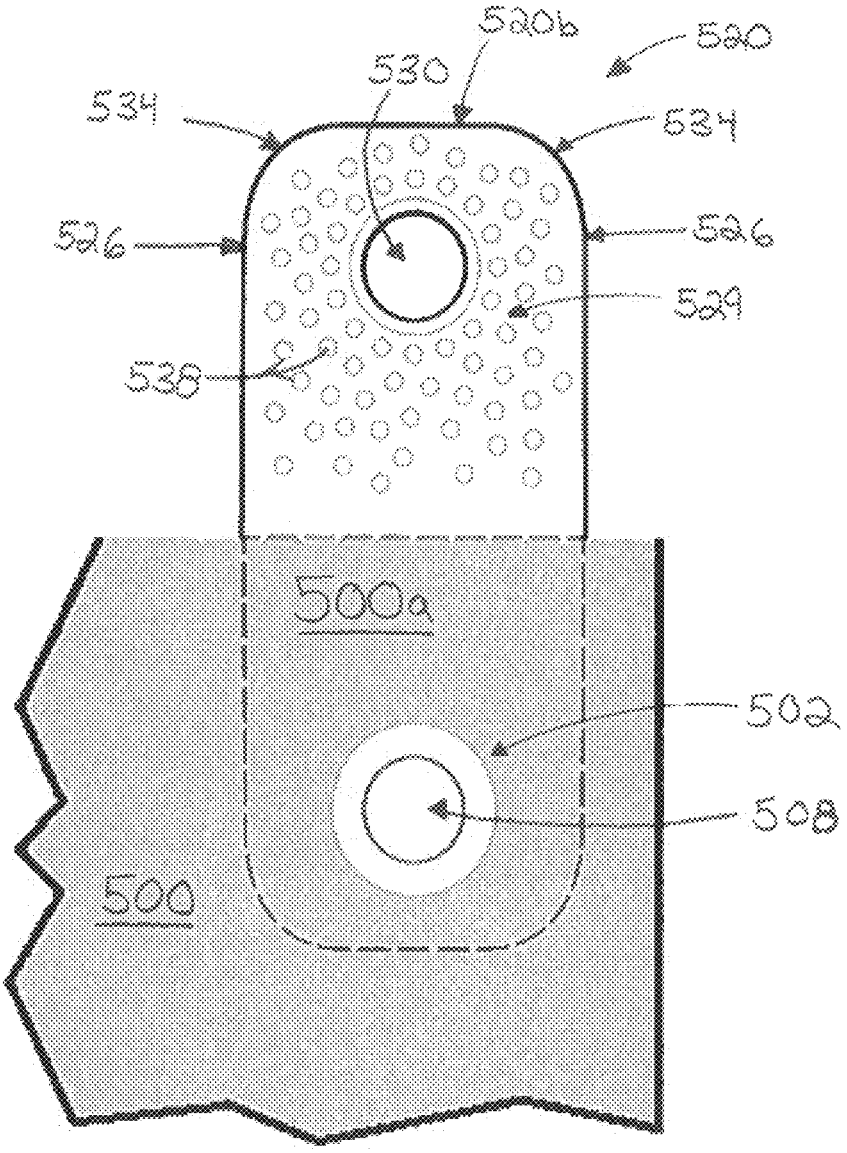
FIG. 20 is an end elevation view of a towel with the retention member of FIG. 1A, where the towel includes an integrated tab receiver.
Figure 21A:
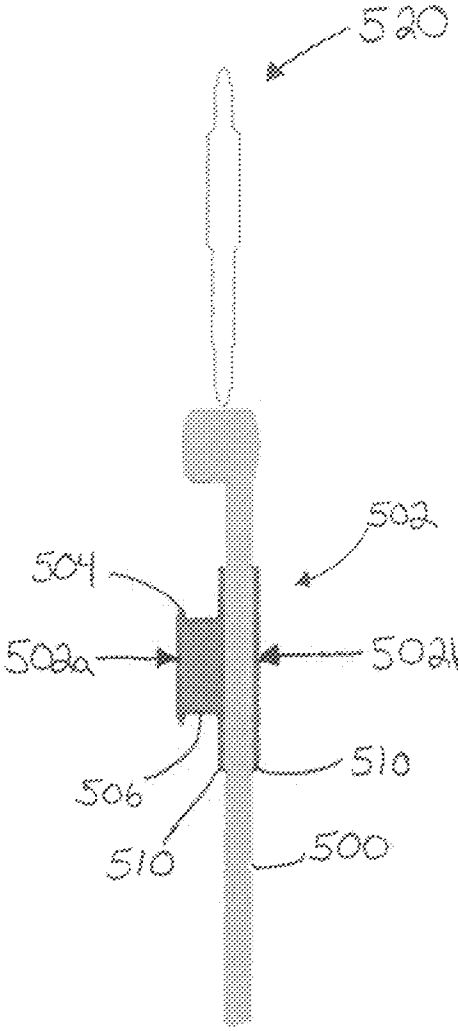
FIG. 21A-E are side elevation views of the towel with the retention member of FIG. 1A and the tab receiver of FIG. 21, showing the attachment member rotating from an unlocked position to a locked position.
Figure 21B:
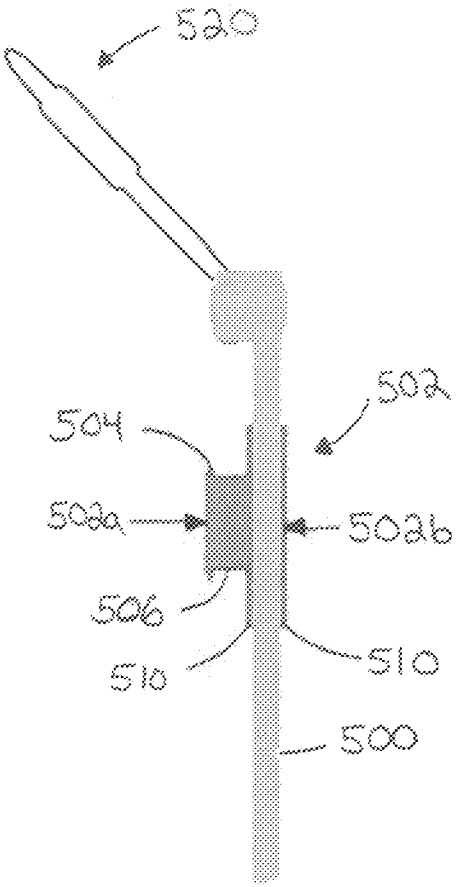
Figure 21C:
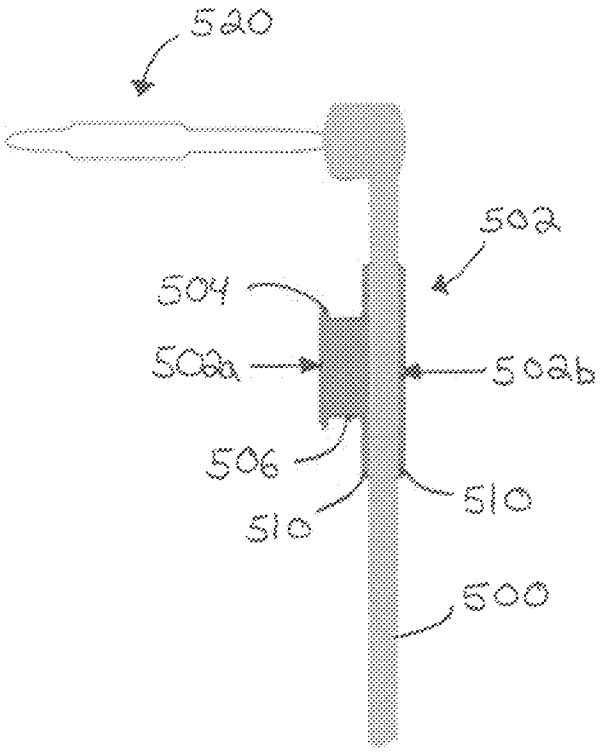
Figure 22:
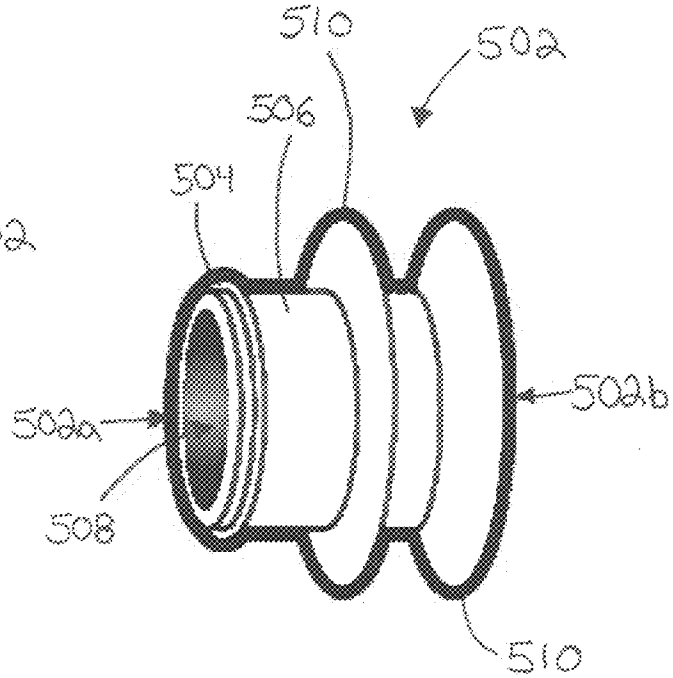
FIG. 22 is a perspective view of the tab receiver of FIG. 20.
Figure 21E:
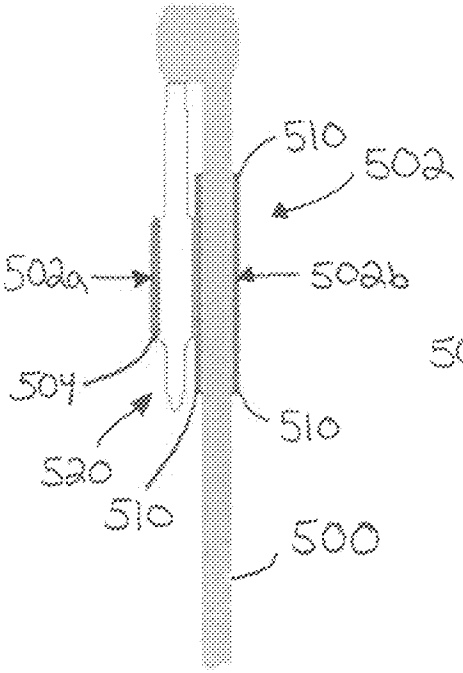
Figure 21D:
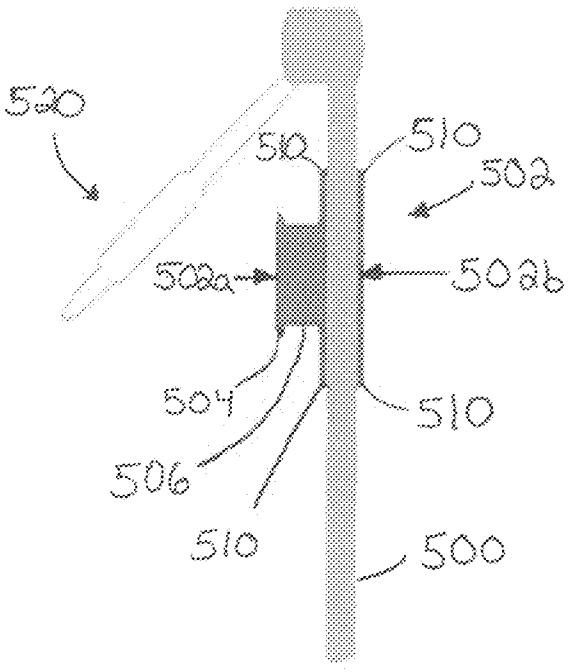

Referring now to the illustrated embodiment of FIGS. 20-22, a towel 500 includes both an integrated retention tab 520 and an integral receiving tab or tab receiver 502, where retention tab 520 is of substantially similar construction as retention tab 20 discussed above. Tab receiver 502 can be used to selectively "stow" or otherwise adjust retention tab 520 between a locked position (FIG. 21E) and an unlocked position (FIGS. 21A-D). In the locked position, retention tab 520 is pressed against and/or oriented substantially parallel to an adjacent portion 500*a* of towel 500 (FIG. 20). In the unlocked position, retention tab 520 may freely rotate relative to towel 500. Tab receiver 502 has an annular flange in the form of coupler flange 504 near its outboard end 502*a*. Coupler flange 504 is configured to fit and protrude through hole 530 when sufficient force is provided to press retention tab 520 towards an inboard end 502*b* of tab receiver 502. As best shown in FIG. 22, coupler flange 504 secures retention tab 520 within a saddle area 506 until retention tab 520 is acted upon by a person with sufficient force to overcome coupler flange 504. In this way, retention tab 520 can be selectively adjusted into either the locked or unlocked positions. Tab receiver 502 also defines a through hole in the form of channel 508. While retention tab 520 is in the locked position, hole 530 and channel 508 are aligned such that a hook or other object may protrude through hole 530 and channel 508 to enable towel 500 to be hanged for drying purposes or otherwise. In the illustrated embodiment, tab receiver 502 is affixed to towel 500 via a compression fit configuration in which two securing flanges 510 are disposed on each side of towel 500. It will be appreciated that a tab receiver could be secured to a towel through many methods, including, stitching, adhesives, fasteners, or otherwise.

Figure 23A:
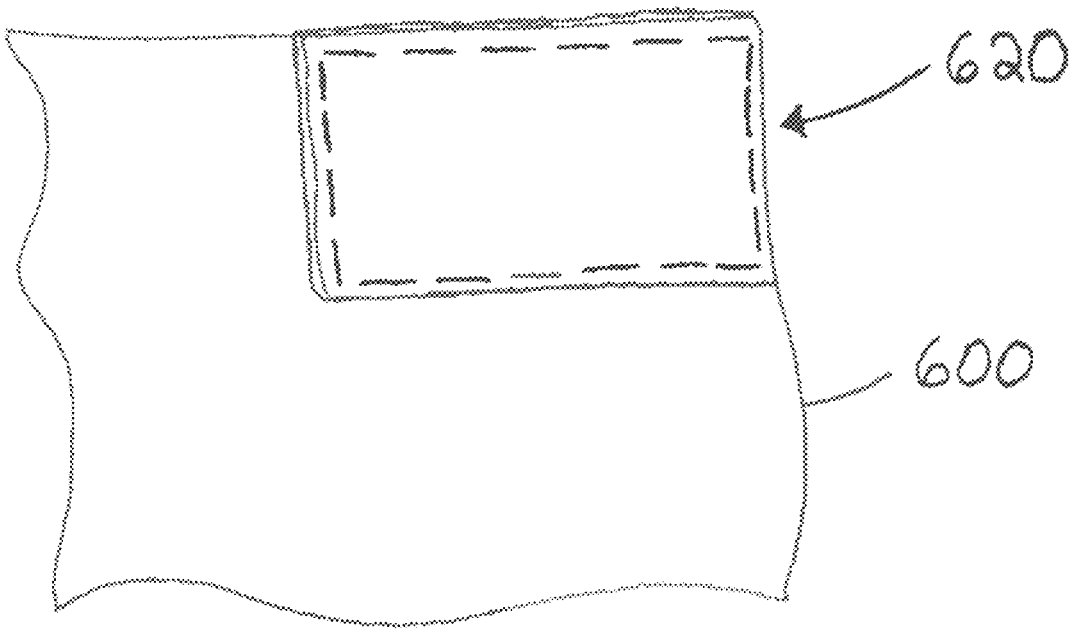
FIG. 23A is a front perspective view of a towel with an integrated attachment member in accordance with the present invention, where the entire perimeter of the attachment member is sewn into the towel, and where the attachment member does not extend past the edge of the towel.
Figure 23B:
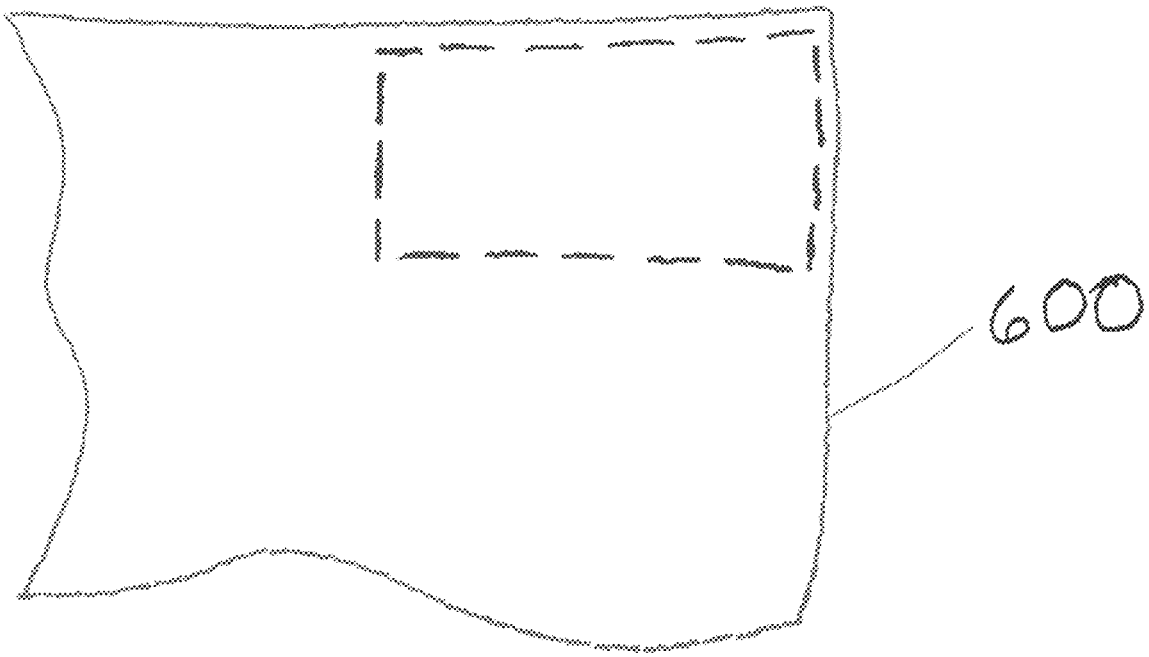
FIG. 23B is a rear perspective view of the towel with the integrated attachment member of FIG. 23A.

Referring now to the illustrated embodiment of FIGS. 23A and 23B, a towel 600 includes an integrated retention tab 620 that is attached to the towel such that no portion of retention tab 620 extends past any outer edge of towel 600. Specifically, retention tab 620 is attached to towel 600 such that retention tab 620 is approximately flush with the corner of towel 600. The entire perimeter of retention tab 620 is sewn to towel 600 to attach retention tab 620 to towel 600. In the illustrated embodiment, retention tab is approximately one-eighth of an inch in thickness and is attached at a corner of towel 600 by sewing tab 620 onto towel, such as over hems on towel 600. Alternatively, tab 620 may be sewn into the hems of towel 600, such as being sewn into or as part of one or more hems on the edges of towel. In the orientation of the illustrated embodiment of FIGS. 23A and 23B, the long edge of towel 600 is shown to be aligned with the longer edge or side of tab 620 (horizontally in the orientation shown in FIGS. 23A and 23B), and the shorter edge of towel 600 is shown to be aligned with the shorter edge or side of tab 620 (vertically in the orientation shown in FIGS. 23A and 23B).

Accordingly, the retention tab of the present invention provides an easy and effective way to secure a towel in a wrapped position around a person. The retention tab is affixed to the towel near the edge of the towel so as to minimally interfere with using the towel for drying oneself. After the towel has been wrapped around the person, the retention tab may then be tucked between the towel and the person's body to fully secure the towel in the wrapped position. The retention tab is wedge-shaped to facilitate the process of securing the towel in a wrapped position around the person. Optionally, the retention tab may define various gripping patterns, through holes, and/or grommets, and may be molded into various shapes and sizes.

Changes and modifications in the specifically described embodiments may be carried out without departing from the principles of the present invention, which is intended to be limited only by the scope of the appended claims, as interpreted according to the principles of patent law including the doctrine of equivalents.

The embodiments of the invention in which an exclusive property or privilege is claimed are defined as follows:

1. A towel with integrated retention tab comprising:
a towel having an attachment area;
a retention tab secured to said towel at said attachment area;
wherein said retention tab comprises a proximal end, a distal end and opposed sides, with said proximal end coupled to said towel at said attachment area, and wherein said retention tab is configured to engage with a portion of said towel when wrapped around a person to aid in retaining said towel in position on the person, and wherein said retention tab is wedge-shaped and said distal end and said opposed sides comprise tapered edges.

2. The towel with integrated retention tab of claim 1, wherein said retention tab defines a through hole.

3. The towel with integrated retention tab of claim 2, wherein said towel further comprises a receiving tab configured to protrude through said through hole to secure said retention tab in a locked position in which said retention tab is substantially parallel to an adjacent portion of said towel when the towel is in a flat orientation.

4. The towel with integrated retention tab of claim 3, wherein said receiving tab defines a channel that concentrically aligns with said through hole while said retention tab is in said locked position.

5. The towel with integrated retention tab of claim 1, wherein said retention tab comprises a plurality of raised projections defining a gripping pattern.

6. The towel with integrated retention tab of claim 1, wherein said towel is made of cloth and wherein said retention tab is formed of a different material than said towel.

7. The towel with integrated retention tab of claim 1, wherein said retention tab is secured to said towel at an edge of said towel in a downward attachment configuration.

8. The towel with integrated retention tab of claim 1, wherein said distal end terminates in a tapered edge.

9. The towel with integrated retention tab of claim 8, wherein said opposed sides terminate at tapered edges.

10. The towel with integrated retention tab of claim 9, wherein said retention tab comprises rounded corners at said distal end.

11. The towel with integrated retention tab of claim 1, wherein said retention tab is made of a plastic, elastomeric or rubberized material.

12. The towel with integrated retention tab of claim 1, wherein said retention tab is shaped to resemble an identifiable logo, plant, animal, object or character.

13. The towel with integrated retention tab of claim 1, wherein said retention tab is secured to said towel at an edge of said towel in an upward attachment configuration.

14. The towel with integrated retention tab of claim 13, wherein said retention tab defines a through hole.

15. A towel with integrated retention tab comprising:

a towel having an edge defining an attachment area;

a retention tab secured to said towel at said attachment area, wherein said retention tab is formed of a different material than said towel;

wherein said retention tab comprises a proximal end, a distal end and opposed sides, with said proximal end coupled to said towel at said attachment area, and wherein said retention tab is wedge-shaped and said distal end and said opposed sides comprise tapered edges.

16. The towel with integrated retention tab of claim 15, wherein said retention tab comprises a plurality of raised projections on at least one of said opposed sides.

17. The towel with integrated retention tab of claim 15, wherein said retention tab further defines a through hole.

18. The towel with integrated retention tab of claim 15, wherein said retention tab is secured to said towel in either a downward attachment configuration or an upward attachment configuration.

19. The towel with integrated retention tab of claim 15, wherein said towel is made of cloth and said retention tab is made of a plastic, elastomeric or rubberized material.

20. The towel with integrated retention tab of claim 15, wherein said retention tab is sewn to said towel.

* * * * *